US005348129A

United States Patent [19]

Zirkiev

[11] Patent Number: 5,348,129

[45] Date of Patent: Sep. 20, 1994

[54] COIN CHUTE ASSEMBLY HAVING REMOVABLE SIZING INSERTS FOR SIZING COINS

[75] Inventor: Arkady Zirkiev, Forest Hills, N.Y.

[73] Assignee: Greenwald Industries, Inc., Brooklyn, N.Y.

[21] Appl. No.: 49,839

[22] Filed: Apr. 19, 1993

[51] Int. Cl.[5] ..... G07F 5/06

[52] U.S. Cl. ..... 194/235; 194/257

[58] Field of Search ..... 194/234, 235, 249, 253, 194/257, 254, 258

[56] References Cited

U.S. PATENT DOCUMENTS

| | | | |
|---|---|---|---|
| 3,712,440 | 1/1973 | Greenwald | 194/235 |
| 3,978,960 | 9/1976 | Mellinger et al. | 194/235 |
| 4,098,385 | 7/1978 | McNally | 194/235 |
| 4,401,202 | 8/1983 | Gitlin et al. | 194/235 X |
| 4,501,349 | 2/1985 | Giepen | 194/235 |
| 4,502,584 | 3/1985 | Lambiris | 194/257 |
| 4,977,995 | 12/1990 | Hall | 194/257 X |

FOREIGN PATENT DOCUMENTS

| | | | |
|---|---|---|---|
| 1374857 | 11/1974 | United Kingdom | 194/235 |

*Primary Examiner*—Michael S. Huppert
*Assistant Examiner*—Scott L. Lowe
*Attorney, Agent, or Firm*—McAulay Fisher Nissen Goldberg & Kiel

[57] ABSTRACT

The disclosure is directed to a coin chute assembly which includes a sizing block having a plurality of vertical slots each disposed to receive one of a plurality of removable sizing inserts. The sizing block has a horizontal groove in the top surface which communicates with the vertical slots. Each insert has a flange portion received in the horizontal groove and a downwardly extending notch defining stem portion which fits within a separate one of the vertical slots. The notch portion of each insert defines the upper edge of an acceptably sized coin needed to operate the assembly. Fasteners are provided to removably fasten the sizing block within the assembly to permit replacement of the inserts as needed.

16 Claims, 2 Drawing Sheets

COIN CHUTE ASSEMBLY HAVING REMOVABLE SIZING INSERTS FOR SIZING COINS

BACKGROUND OF THE INVENTION

I. Field of the Invention

This invention is directed to a coin chute assembly in which a plurality of removable sizing inserts are positioned within a sizing block for sizing coins, thereby permitting coins of an acceptable diameter to effect operation of an appliance to which the assembly is mounted.

II. Description of the Prior Art

Coin chute assemblies are usually installed on commercial appliances such as clothes washers, dryers, vending machines, and the like. The assembly typically is enclosed within a housing mounted on the appliance or machine. The assembly includes a coin chute having a coin slide reciprocally mounted in a guide track for inserted and retracted movement. The coin slide is formed having one or more coin receiving slots whereby the presence of an appropriately sized coin in the slot is operative to allow inward or inserted movement of the coin slide to the operate position thereof. The inner end of the coin slide is provided with an operator for actuating the appliance or machine upon continued inserted movement of the slide inwardly of the assembly to its operate position.

The housing of the assembly usually is provided with a locked coin drawer which prevents unauthorized access to a coin receptacle located below and in spaced relation to the coin slide. The arrangement is such that the coins necessary to operate the appliance or machine are carried by the coin slide upon inserted movement of the slide to its operate position whereupon the coins exit from the assembly through suitable openings thereby to be transmitted to the coin receptacle.

For coin chute assemblies operable by coins disposed in a vertical position, it is customary to provide a coin sizing block having a camming surface disposed above and in predetermined spaced relation with respect to a pivotally mounted blocking dog so as to permit displacement of the dog to a non-blocking position only when an appropriately sized coin is advanced toward the inserted operative position of the coin slide. Specifically, in U.S. Pat. No. 3,712,440 dated Jan. 23, 1973 in the name of Harry Greenwald, the camming surface is defined by the bottom end of a set screw for engaging the periphery of a coin carried by the coin slide. The set screw is adjustably positioned within a threaded bore so that the spacing between the camming surface and the blocking dog is slightly less than the diameter of a properly sized coin required to operate the assembly. That is, upon inserted movement of the coin slide, the camming surface of the set screw displaces a properly sized coin downwardly. In doing so, the associated blocking dog is displaced to an amount sufficient to move out of the path of travel of the coin slide to permit the slide to be advanced to its operate position. The coin sizing arrangement in this '440 patent requires a skilled technician to position the set screw for proper spacing relative to the blocking dog. There also is a tendency for the set screw to move from its set position upon repeated use of the coin chute assembly thereby requiring frequent servicing of the assembly.

Another coin sizing block configuration is provided in U.S. Pat. No. 4,502,584 dated Mar. 5, 1985 in the name of Christos Lambiris. The camming surface in this patent is defined by inverted V-shaped notches or grooves provided in a sizing block fixed in position above the guide track. The notches are aligned with the coin receiving slots in the coin slide. There also is provided a plurality of pivotally mounted blocking dogs along the guide track wherein each dog is aligned with a separate one of the coin slots and with a separate one of the notches in the sizing block. The dogs are biased into a normal blocking position in the path of travel of the slide, and are disposed for movement from their blocking position to a displaced non-blocking position. The arrangement is such that inserted movement of the coin slide causes a properly sized coin to ride onto the corresponding blocking dog with the upper edge of the coin received in and engaging the corresponding notch in the sizing block. The spacing between the notch and the dog is such as to cause the engaged coin to press down against the corresponding dog and move said dog to its displaced non-blocking position.

If the coin chute assembly of the '584 patent accommodates only coins of the same size; that is the same denomination, all of the V-shaped notches or grooves in the coin sizing block will be of equal size and depth. However, if the coin chute is configured to accept coins of more than one size, the size and depth of the V-shaped notches or grooves must match the coins' dimensions accordingly. Furthermore, the relative position to each other of two or more different size coins can vary depending on ease of operation and the customer's preference. As a consequence, the sizing block arrangement of this patent can be somewhat expensive since it necessitates that a potentially large number of sizing blocks be manufactured and kept in inventory in order to suit the many combinations of coin sizes and coin positions for operating the coin chute assembly.

The present invention represents an improvement over the heretofore known assemblies by having a universal sizing block configured to receive a plurality of sizing inserts. These inserts can be replaced to accommodate any desired configuration of coins needed for operating the coin chute assembly without requiring the cost of having a separate sizing block for each such configuration.

SUMMARY OF THE INVENTION

The coin chute assembly of the present invention includes a sizing block having a plurality of vertical slots each disposed to receive one of a plurality of removable sizing inserts. The sizing block further is formed having a horizontal groove in the top surface of the block which is in communication with the vertical slots. Each of the sizing inserts has a flange portion and a downwardly extending notch defining stem portion. The notch portion of each insert defines the upper edge of an acceptably sized coin. The stem portion of each of the sizing inserts fits within a separate one of the slots with the flange portion positioned flush with the top surface of the sizing block. Fasteners are provided to removably fasten the sizing block within the coin chute assembly. The arrangement is such that the sizing block can be removed from the assembly so that one or more of the sizing inserts can be replaced to either adapt to a different size coin or to provide replacement for worn or damaged inserts.

For a better understanding of the invention and its various features and advantages, reference should be made to the following detailed description when taken in conjunction with the accompanying drawings.

DESCRIPTION OF THE PREFERRED EMBODIMENTS

Figure 1:
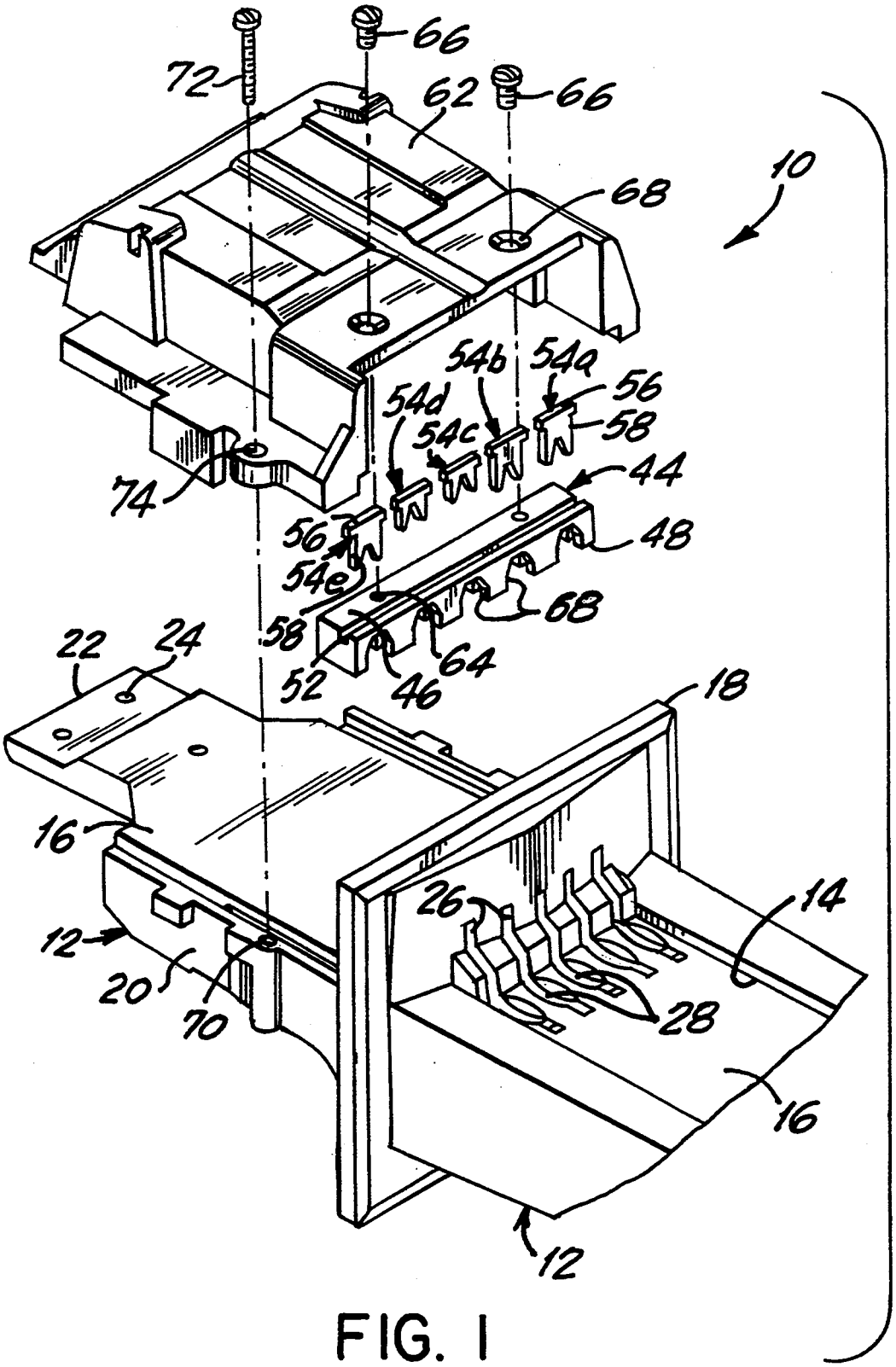
FIG. 1 is an exploded view, in perspective, of the coin chute assembly embodying the present invention with the sizing block configured to receive a plurality of different sizing inserts.

Referring to the drawings, there is shown a coin chute assembly represented generally by numeral 10 constructed in accordance with the present invention. Assembly 10 includes a housing 12 provided with a guide track 14 reciprocally supporting a coin slide 16 for inserted and retracted movement within said housing. Assembly 10 is adapted to be mounted on a housing (not shown) which, in turn is mounted on a commercial appliance such as a clothes washer, dryer, vending machine and the like. To this end, housing 12 has a mounting plate subassembly 18 formed with mounting lugs (not shown) adapted to be received in suitable openings in the wall of the housing that is mounted to the commercial appliance to support the coin chute assembly 10 firmly in place. The housing wall which receives the mounting lugs also is provided with an enlarged opening through which the inner portion 20 of housing 12 passes when assembly 10 is mounted in place. The precise manner in which assembly 10 is mounted in place is well known in the art, such as disclosed in U.S. Pat. No. 4,502,584, so that a more detailed description of the mounting arrangement is not deemed necessary.

As is apparent from the drawings, coin slide 16 is adapted to carry a plurality of coins in a vertical or standing on edge position inwardly of housing 12 upon inserted movement of said slide 16 to its operate position. Inserted movement of slide 16 serves to transmit the coins to a coin receptacle (not shown) positioned within the housing that is mounted to the commercial appliance. Access to the coin receptacle is gained through a locked coin drawer suitably located in said latter housing whereby the coin drawer may be unlocked and the contents of the coin receptacle removed at periodic intervals. The coin slide 16 typically is provided with an operator (not shown) mounted on the inner end portion 22 thereof, by means of threaded openings 24, for actuating the appliance or machine upon advanced or inserted movement of said slide. The coin slide 16 is spring-loaded, in conventional manner, thereby to return the slide to its retracted position to complete the movement cycle of the slide. The aforesaid description, again, is well known in the art.

Mounting plate 18 is provided with a substantially centrally located opening through which passes the coin carrying portion of coin slide 16. Plate 18 further is formed having a plurality of open ended slots 26 disposed vertically and in parallel relation to one another. The open ends of slots 26 communicate with the central opening in plate 18 and are disposed to permit passage of a plurality of coins carried by coin slide 16 in a vertical or standing on edge position upon inserted movement of the coin slide whereby the coins pass through plate 18 and are carried to a coin sizing mechanism as hereinafter described.

Coin slide 16 is formed having a plurality of coin support slots 28 each adapted to hold a coin 30 placed therein in a vertical plane. The arrangement is such that each of the slots 26 in plate 18 is aligned with a separate one of the coin support slots 28 in coin slide 16 when said slide is mounted in guide track 14 for reciprocal movement therein.

As is known in the art, the vending machine operator is able to select the specific amount and denomination of coins, within limits, necessary to operate the appliance or machine. If needed, there is provision for blanking out one or more of the coin support slots 28 to reduce the number of coins necessary to operate the mechanism.

In order to prevent full insertion of coin slide 16 when it is not carrying any coins or when the slide is carrying improperly sized coins, a set of blocking dogs 32 are pivotally mounted to the undersurface of housing inner portion 20 by means of pivot pins 34. Each dog 32 has a hook-shaped end portion 36 disposed along guide track 14. The hook end is formed having a shoulder surface 38 which functions as a stop against which an undersurface edge 40 of coin slide 16 abuts when the slide is moved in its inserted direction thereby to limit the extent to which the slide may be inserted without a proper coin 30 in coin support slot 28. Intermediate the hook end 36 and the pivotally mounted end 34 is a platform section 42 which defines the upper surface of dog 32. Platform 42 is disposed to lie along the path of travel of a coin 30 upon inserted movement of coin slide 16 as hereinafter described.

Each of the blocking dogs 32 is aligned with a separate one of the coin support slots 28 and is biased by a spring (not shown) into a normal blocking position wherein the hook end 36 is positioned in the path of travel of coin slide 16. As such, the engagement of coin slide edge 40 with the shoulder surface 38 of any one of the dogs 32 will stop or prevent further inserted movement of slide 16 when the slide carries either no coin or an improperly sized coin.

Figure 2:
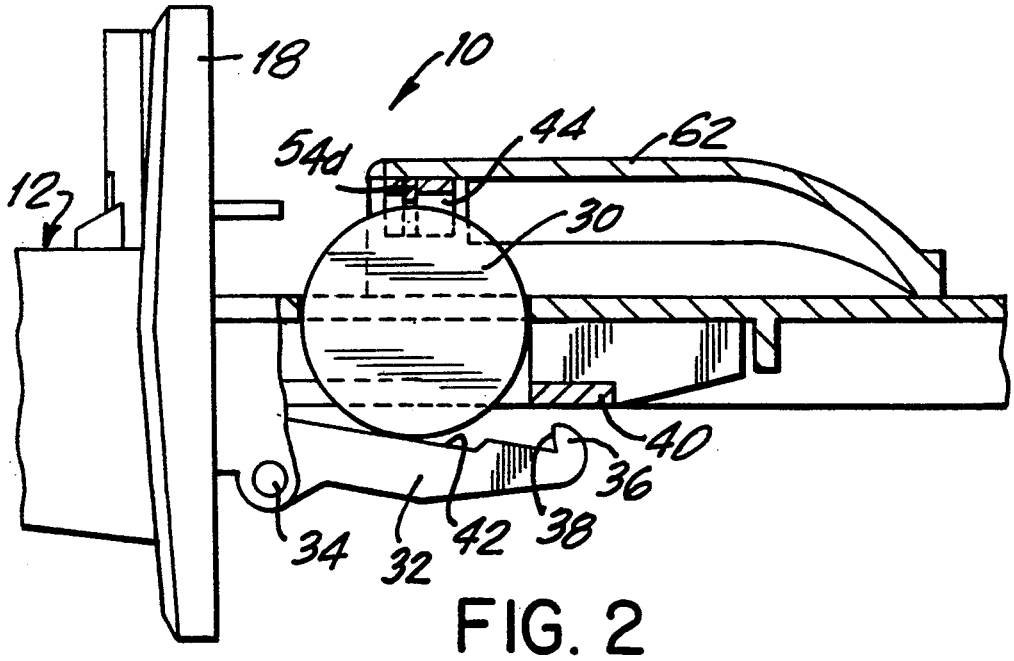
FIG. 2 is a partial longitudinal sectional view of the coin chute assembly with a properly sized coin in engagement with the sizing block thereby to move the blocking dog to its displaced non-blocking position to permit continued movement of the coin slide to its inwardly inserted position.
Figure 3:
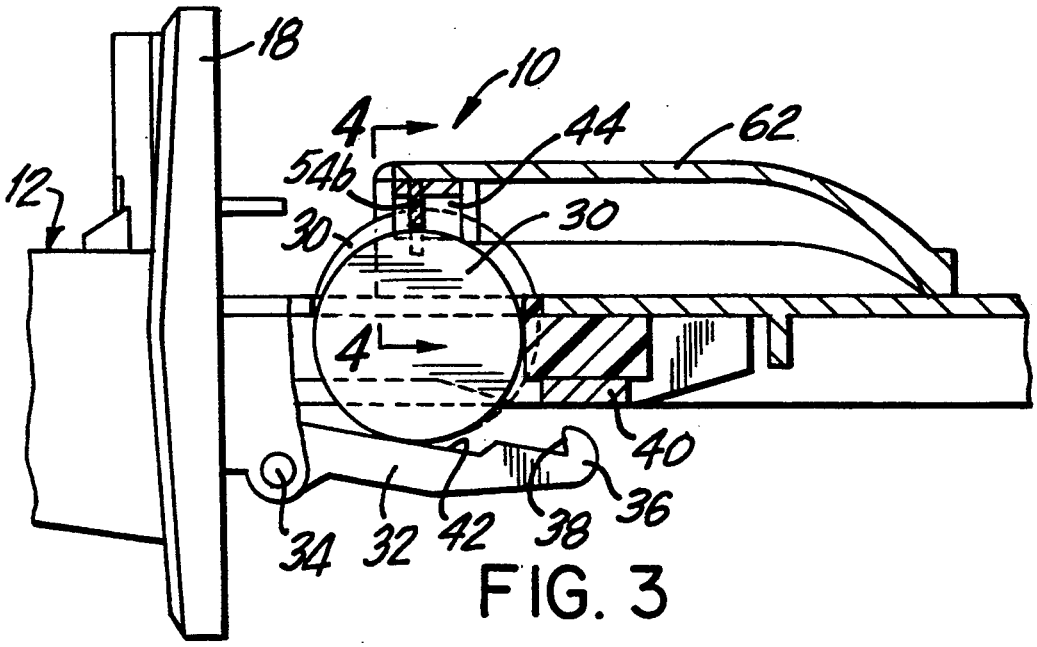
FIG. 3 is a partial sectional view similar to FIG. 2 showing a plurality of properly sized coins in engagement with separate sizing inserts of the sizing block and with the associated blocking dogs displaced to their non-blocking position.

The blocking dogs 32 are disposed for movement between the aforesaid normal blocking position and a displaced non-blocking position, as shown in FIGS. 2 and 3, upon inserted movement of coin slide 16 carrying with it properly sized coins 30. In this regard, inserted movement of coin slide 16 causes coins in any of the coin support slots 28 to ride onto the platform 42 of the respective ones of the blocking dogs 32. The manner in which the properly sized coins 30 function to move the associated blocking dogs 32 to their displaced non-blocking position will be hereinafter described in connection with the sizing block mechanism of the assembly.

Positioned inward of mounting plate 18 and above guide track 14 is a sizing block 44 having a top surface 46 and a bottom surface 48. A plurality of vertical slots 50 extend upwardly from bottom surface 48 to top surface 46 and are spaced along the horizontal extent of the block. A groove 52 extends horizontally across the top surface 46 of block 44 and is in communication with the vertical slots 50.

Figure 4:
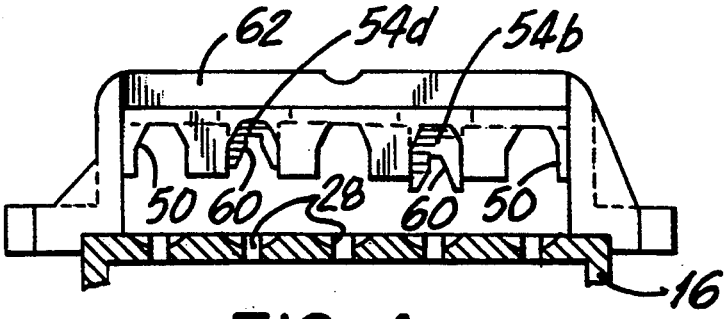
FIG. 4 is a cross-sectional view taken along line 4—4 of FIG. 3, with the coins removed to show the position of the sizing inserts within the sizing block.

The invention provides for a separate sizing insert to be received in each of the vertical slots 50. The inserts are represented in FIG. 1 by numerals 54*a* through 54*e*, corresponding in number to the five vertical slots 50 which, in turn, corresponds in number to the five coin support slots 28 for this specific assembly. It will be appreciated that the actual number of vertical slots 50 in block 44 will be a function of the number of coin support slots 28 in coin slide 16, and that the actual number of inserts needed for any given application of use will depend on the specific amount and denomination of coins selected by the vending machine operator to operate the appliance or machine. For example, FIG. 4 shows only two inserts associated with block 44, one to accommodate a 25 cent coin and the other to accommodate a 5 cent coin. The 5 cent insert is the one positioned further to the right as viewed in FIG. 4.

Each of the sizing inserts 54*a*–54*e* has a flange portion 56 and stem portion 58 extending downwardly from the flange portion. Each stem portion 58 is formed having a notch 60 which, when assembly 10 is in use, defines the upper edge of an acceptably sized coin. That is, upon inserted movement of coin slide 16, coin 30 rides onto platform 42 of dog 32. The upper edge of the coin is received within notch 60 of the associated sizing insert which is aligned over the associated dog, as viewed in FIGS. 2 and 3, with the notch serving as a camming surface to urge the coin downwardly and thereby pivot blocking dog 32 clockwise and displace said dog to its non-blocking position. As will be further appreciated, the spacing between notch 60 and platform 42, when blocking dog 32 is in its blocking position, is less than the diameter or vertical height of a properly sized coin.

As seen in FIGS. 1 and 4, the length of each flange portion 56 is greater than the width of each of the vertical slots 50. Also, the sizing inserts 54*a*–54*e* are dimensioned such that the step portions 58 have a slip fit relationship with the associated one of the slots 50 in sizing block 44, and with the flange portions 56 received within the groove 52 of said block. At such time as an insert is dropped within the associated slot, the flange portion bridges and spans across the width of the slot to position the insert within the sizing block with the notch portion spaced at the pre-set and predetermined distance from the associated blocking dog for accepting a properly sized coin to operate the mechanism.

Housing 12 includes a cover 62 to which the sizing block 44 is removably fastened. For this purpose, as seen in FIG. 1, the top surface 46 of bock 44 is formed having threaded openings 64 which receive the ends of threaded fasteners or screws 66; said threaded ends passing through aligned openings 68 in cover 62. Housing 12 includes additional threaded openings 70 positioned at the sides thereof for receiving the threaded end of fasteners 72; said threaded ends passing through aligned openings 74 in cover 62 thereby to removably fasten cover 62 in place. The arrangement permits the block to be removed from the housing, and in particular from the cover, so that one or more of the inserts can be replaced to either adapt to a different size coin or to provide replacement for worn or damaged inserts.

As seen in FIGS. 2–4, when the sizing inserts are inserted within the sizing block, the upper surface of the flange portion or each insert is disposed to abut against the undersurface of the cover thereby to secure the inserts vertically in place. The inserts are positioned horizontally by the engagement of the stem portions within the associated slots of the block. Also, when the inserts are in place, the upper surface of the flange portion of each insert is flush with the top surface of the sizing block.

Since the inserts are separable from the sizing block, and it is only the inserts which are engageable by the coins and subjected to impact forces, it is necessary to only make the inserts of hardened material, such as steel, as compared to the softer material of the block, which may be zinc die cast or plastic.

It will thus be appreciated that there is disclosed an improved coin chute assembly having advantages which provide flexibility and replaceability of sizing inserts at reduced cost. By having a universal sizing block, sizing inserts can be replaced to provide any desired configuration of coins for the coin slide without requiring the cost of a separate sizing block for each configuration. Since it is the sizing inserts which wear and have to be precisely positioned, this design makes it possible to provide sizing inserts made of a relatively expensive, hard, wear resistant material with a sizing block that can be made of a relatively inexpensive material.

Furthermore, because of the slip fit relationship of the sizing inserts to the openings in the sizing block, it becomes relatively easy and inexpensive to replace inserts. The advantages of replacement of inserts is that it makes possible a greater flexibility in terms of the coins that can be accepted by the coin slide and also makes it possible to inexpensively replace inserts which have become worn or otherwise damaged. In addition, the arrangement provides a coin chute assembly in which the installer does not have to make any adjustments for the desired coin because the insert is sized so that when it fits into the sizing block, the desired spacing to the blocking dog is automatically achieved without further adjustment.

While the present invention has been described with respect to a particular embodiment, it will be readily appreciated and understood that numerous variations and modifications thereof may be made without departing from the spirit or scope of the claimed invention.

What is claimed is:

1. In a coin chute assembly having a housing and a coin slide mounted for reciprocal movement within said housing, the improvement comprising:

a sizing block and a plurality of removable sizing inserts held within said sizing block for sizing coins;

said sizing block having an upper surface formed with a groove portion extending across said surface, and further having a plurality of slot portions in communication with said groove portion;

each of said sizing inserts having a flange portion and a stem portion extending downwardly therefrom;

the groove portion of said sizing block adapted to receive the flange portion of each sizing insert and the respective slot portions of said block adapted to receive the stem portion of a separate one of said inserts;

each of the stem portions of said sizing inserts being dimensioned to define an upper edge of a predetermined sized coin for said coin slide when said inserts are positioned within said sizing block; and each of said sizing inserts having a slip fit relationship with the associated one of said slot portions in said sizing block to provide positioning of said inserts in said block.

2. The coin chute improvement of claim 1 wherein: said sizing inserts are made of a harder more durable material than is said sizing block.

3. The coin chute improvement of claim 1 wherein: said sizing inserts comprise at least first and second types of inserts having stem portions respectively defining first and second depths thereby defining first and second acceptable coin diameters.

4. The coin chute improvement of claim 1 wherein: said sizing block includes fastening means for removably fastening said block to said housing;

whereby said block can be removed from said housing so that one or more of said sizing inserts can be replaced to either adapt to a different size coin or to provide replacement for worn or damaged inserts.

5. The coin chute improvement of claim 1 wherein: the flange portions of said sizing inserts have upper surfaces which are flush with a surface of said sizing block when said inserts are assembled into said block.

6. The coin chute improvement of claim 1 wherein: the groove of said sizing block extends horizontally across the upper surface of said block, and the slot portions of said block extend vertically downwardly from said upper surface.

7. The coin chute improvement of claim 1 wherein: the stem portion of each sizing insert includes a notch to define the upper edge of an acceptably sized coin.

8. The coin chute improvement of claim 7 wherein: said sizing inserts comprise at least first and second types of inserts having stem portions respectively defining first and second notch depths thereby defining first and second acceptable coin diameters.

9. In a coin chute assembly having a housing defining a guide track and a coin slide reciprocally mounted in said guide track for inserted and retracted movement within said housing, the improvement comprising:

a sizing block and a plurality of sizing inserts positioned in said sizing block for sizing coins;

said sizing block having a top surface and a bottom surface, and further having a plurality of vertical slots extending upwardly from said bottom surface;

said sizing block having a groove in the top surface of said block, said groove being in communication with said vertical slots;

each of said sizing inserts having a flange portion and a notch defining stem portion extending downwardly from said flange portion, the notch portion of each of said inserts defining the upper edge of an acceptably sized coin;

the stem portion of each of said sizing inserts fitting within a separate one of said slots and the flange portion of each of said inserts fitting within said groove to position said inserts within said sizing block; and the flange portion of each of said sizing inserts having an upper surface sized to abut against a surface of the housing within which said sizing block is mounted;

whereby in assembly each of said sizing inserts is positioned vertically by the engagement of the upper surface of said flange portion against the surface of said housing and is positioned horizontally by the engagement of said stem portion within the associated slot of said sizing block.

10. The coin chute improvement of claim 9 wherein: the upper surfaces of said flanges of said sizing inserts are flush with the top surface of said sizing block when said inserts are assembled into said block.

11. The coin chute improvement of claim 9 wherein: said sizing inserts are made of a harder more durable material than is said sizing block.

12. The coin chute improvement of claim 9 wherein: the stem portions of said sizing inserts have a slip fit relationship with the associated slots of said sizing block.

13. The coin chute improvement of claim 9 wherein: said sizing inserts comprise at least first and second types of inserts having stem portions respectively defining first and second notch depths thereby defining first and second acceptable coin diameters.

14. The coin chute improvement of claim 9 wherein: said sizing block includes fastening means for removably fastening said block to said housing;

whereby said block can be removed from said housing so that one or more of said sizing inserts can be replaced to either adapt to a different size coin or to provide replacement for worn or damaged inserts.

15. The coin chute improvement of claim 9 wherein: the groove of said sizing block extends horizontally across the top surface of said block.

16. In a coin chute assembly having a housing and a coin slide mounted for reciprocal movement within said housing, the improvement comprising:

a sizing block and a plurality of removable sizing inserts held within said sizing block for sizing coins;

said sizing block having an upper surface formed with a groove portion extending across said surface, and further having a plurality of openings in communication with said groove portion and extending downwardly through said block;

each of said openings in said sizing block, in concert with the groove portion communicating therewith, being adapted to receive one of said sizing inserts;

each of said sizing inserts being positioned within said sizing block and being dimensioned to define an upper edge of a predetermined sized coin for said coin slide; and each of said sizing inserts having a slip fit relationship with the associated one of said openings in said sizing block and the groove portion communicating therewith to provide positioning of said inserts in said block.

* * * * *